US009078507B2

(12) United States Patent
Lee

(10) Patent No.: US 9,078,507 B2
(45) Date of Patent: Jul. 14, 2015

(54) SPOUTING-TYPE COSMETIC CONTAINER

(75) Inventor: Do Hoon Lee, Bucheon (KR)

(73) Assignee: PUM-TECH KOREA CO., LTD., Incheon (KR)

( * ) Notice: Subject to any disclaimer, the term of this patent is extended or adjusted under 35 U.S.C. 154(b) by 0 days.

(21) Appl. No.: 14/347,011

(22) PCT Filed: Jul. 26, 2012

(86) PCT No.: PCT/KR2012/005970
§ 371 (c)(1),
(2), (4) Date: Mar. 25, 2014

(87) PCT Pub. No.: WO2013/047989
PCT Pub. Date: Apr. 4, 2013

(65) Prior Publication Data
US 2014/0234007 A1 Aug. 21, 2014

(51) Int. Cl.
*A45D 40/26* (2006.01)
*A45D 34/00* (2006.01)
*B65D 51/32* (2006.01)

(52) U.S. Cl.
CPC ..... *A45D 40/26* (2013.01); *A45D 34/00* (2013.01); *B65D 51/32* (2013.01)

(58) Field of Classification Search
CPC ..... A45D 40/26; A45D 34/00
USPC ..... 141/22–24, 90; 222/320, 321.1, 336, 222/342, 630–631
See application file for complete search history.

(56) References Cited

U.S. PATENT DOCUMENTS

| | | | | | |
|---|---|---|---|---|---|
| 2,781,063 | A | * | 2/1957 | Williams | 141/24 |
| 3,101,751 | A | * | 8/1963 | Ballin | 141/24 |
| 3,820,576 | A | * | 6/1974 | Torrent | 141/24 |
| 4,278,360 | A | * | 7/1981 | Lorscheid et al. | 401/151 |
| 4,376,591 | A | * | 3/1983 | Proffer | 401/127 |
| 4,579,153 | A | * | 4/1986 | Goncalves | 141/23 |
| 5,226,572 | A | * | 7/1993 | Gargione | 222/214 |
| 6,112,779 | A | * | 9/2000 | Camilla | 141/23 |

(Continued)

FOREIGN PATENT DOCUMENTS

| | | | |
|---|---|---|---|
| JP | 7052056 | Y2 | 11/1995 |
| KR | 20-0438535 | Y1 | 2/2008 |

(Continued)

OTHER PUBLICATIONS

International Search Report of PCT/KR2012/005970 dated Oct. 23, 2012.

*Primary Examiner* — Nicolas A Arnett
(74) *Attorney, Agent, or Firm* — Justin H. Kim; Maxon IP LLC.

(57) ABSTRACT

The spouting-type cosmetic container includes: a main container provided with an opening; a pipette tube spouting cosmetic; a cap unit detachably installed to the opening of the main container and including an inner cap and an outer cap encasing the inner cap; an up/down button installed to the upper side of the outer cap to move up and down for a preset stroke and having cam holes formed on the side wall to face the cams; a piston fixed to the lower side of the up/down button to move up and down with the up/down button; and an elastic member elastically reacting to move the up/down button and the piston upward and to spout the cosmetic accommodated in the main container out. A preset amount of cosmetic is discharged and user's convenience may be enhanced.

5 Claims, 4 Drawing Sheets

(56) References Cited

U.S. PATENT DOCUMENTS

| | | | | |
|---|---|---|---|---|
| 8,403,008 | B2 * | 3/2013 | Bouix et al. | 141/27 |
| 2013/0074983 | A1 * | 3/2013 | Choi | 141/23 |
| 2013/0112314 | A1 * | 5/2013 | Lee et al. | 141/23 |
| 2013/0192713 | A1 * | 8/2013 | Drugeon et al. | 141/26 |
| 2014/0361047 | A1 * | 12/2014 | Lee et al. | 222/372 |

FOREIGN PATENT DOCUMENTS

| | | | |
|---|---|---|---|
| KR | 10-2009-0040633 | A | 4/2009 |
| KR | 20-0453126 | Y1 | 4/2011 |

* cited by examiner

SPOUTING-TYPE COSMETIC CONTAINER

CROSS-REFERENCE RELATED APPLICATION

This application claims foreign priority of Korean Patent Application No. 20-2011-0008653, filed on Sep. 27, 2011, which is incorporated by reference in its entirely into this application.

TECHNICAL FIELD

The present invention relates to a spouting-type cosmetic container, and more particularly to a spouting-type cosmetic container for extracting a predetermined amount of cosmetic and providing enhanced user's convenience by moving an up/down button and a piston that are moved down when a cap unit is coupled to a main container upward during the separation of the cap unit from the container by rotation to suction the cosmetic therein and then discharge the suctioned cosmetic out.

BACKGROUND ART

In general, a high-functional cosmetic such as essence, eye cream, anti-aging agent, anti-wrinkle agent is highly expensive and accommodated in a compact cosmetic container.

This cosmetic container simply includes a main container and a cap such that a user opens the cap closing an opening of the main container to discharge and apply the cosmetic on a desired spot on the skin. However, it is difficult for a user to control the discharged amount of the cosmetic and the expensive cosmetic as much as stained on hands is wasted.

On this account, a spouting-type cosmetic container has been developed such that a user may extract a desired amount of cosmetic with a pipette (Spuit) to apply the extracted cosmetic to a desired spot on the skin.

An existing spouting-type cosmetic container 10, as illustrated in FIG. 1, includes a main container 20 accommodating cosmetic therein and a cap unit 30 closing an opening 21 of the main container 20 and being associated with a pipette tube 33 to suction/discharging the cosmetic accommodated in the main container 20.

The main container 20 has male threads 21*a* formed around the outer circumference of the opening 21 for the screw-coupling with the cap unit 30.

The cap unit 30 includes a pipette tube (Spuit) 33 going in and out the main container 20 through the opening 21, a push button 35, and an elastic member 37 provided at the lower side of the push button 35.

However, the existing spouting-type cosmetic container 10 is inconvenient to use because a user couples the cap unit 30 to the main container 20 and separates the push button 35 from the main container 20 by pushing and rotating the push button 35 once.

DISCLOSURE

Technical Problem

The present invention has been made in an effort to solve the above-described problems, and it is an object of the present invention to provide a spouting-type cosmetic container for extracting a predetermined amount of cosmetic and providing enhanced user's convenience by moving an up/down button and a piston that are moved down when a cap unit is coupled to a main body upward during the separation of the cap unit from the container by rotation to suction the cosmetic therein and then discharge the suctioned cosmetic out.

Technical Solution

In accordance with an aspect of the present invention, there is provided a spouting-type cosmetic container including: a main container provided with an opening formed at the top; a pipette tube spouting cosmetic accommodated in the main container out; a cap unit detachably installed to the opening of the main container and including an inner cap thread-coupled with the main container and an outer cap encasing the inner cap and provided with cams formed on the inner circumference thereof; an up/down button installed to the upper side of the outer cap to move up and down for a preset stroke and having cam holes formed on the side wall to face the cams; a piston fixed to the lower side of the up/down button to move up and down with the up/down button; and an elastic member elastically reacting when the cap unit is separated from the main container to move the up/down button and the piston upward and to spout the cosmetic accommodated in the main container out.

The cams make a pair of protrudes protruding inwardly from an inner circumference of the outer cap at positions facing each other, the cam holes includes '/'-shaped slope guides formed in the lower side with a preset angle and penetrate the side wall of the up/down button at a position corresponding to the cams, the cams are supported and rotated clockwise by the slope guides when the up/down button is pressed to move the up/down button down and is transferred with elastic reaction of the elastic member when the cap unit is rotated and separated from the main container and rotates counterclockwise to support the slope guide such that the up/down button is gradually moved upwardly.

The spouting-type cosmetic container further includes a wiper provided between the inner cap and the opening of the main container to wipe down the cosmetic attached to the outer circumference of the pipette tube.

The piston has a T-shape and includes: a fixing protrusion extending from the upper center thereof upward and fixed to a fixing element of the up/down button; and leak-proof segments protruding from both sides of the fixing protrusion outwardly to be in contact with an extension segment of the inner cap to prevent the cosmetic from leaking.

The spouting-type cosmetic container further includes claim 5.

The spouting-type cosmetic container further includes a leak-proof element preventing the cosmetic from leaking between the inner cap and the wiper.

Advantageous Effects

According to the spouting-type cosmetic container of the present invention, a predetermined amount of cosmetic is enabled and enhanced user's convenience can be provided by moving an up/down button and a piston that are moved down when a cap unit is coupled to a main body upward during the separation of the cap unit from the container by rotation to suction the cosmetic therein and then discharge the suctioned cosmetic out.

BEST MODE

Mode for Invention

The above-described and other objects and new features of the present invention will become clearer with reference to the specification and the accompanying drawings.

Particular terms may be defined to describe the invention in the best manner. Accordingly, the meaning of specific terms or words used in the specification and the claims should not be limited to the literal or commonly employed sense, but should be construed in accordance with the spirit of the invention.

Hereinafter, a spouting-type cosmetic container 100 according to an embodiment of the present invention will be described with reference to the accompanying drawings.

Figure 1:
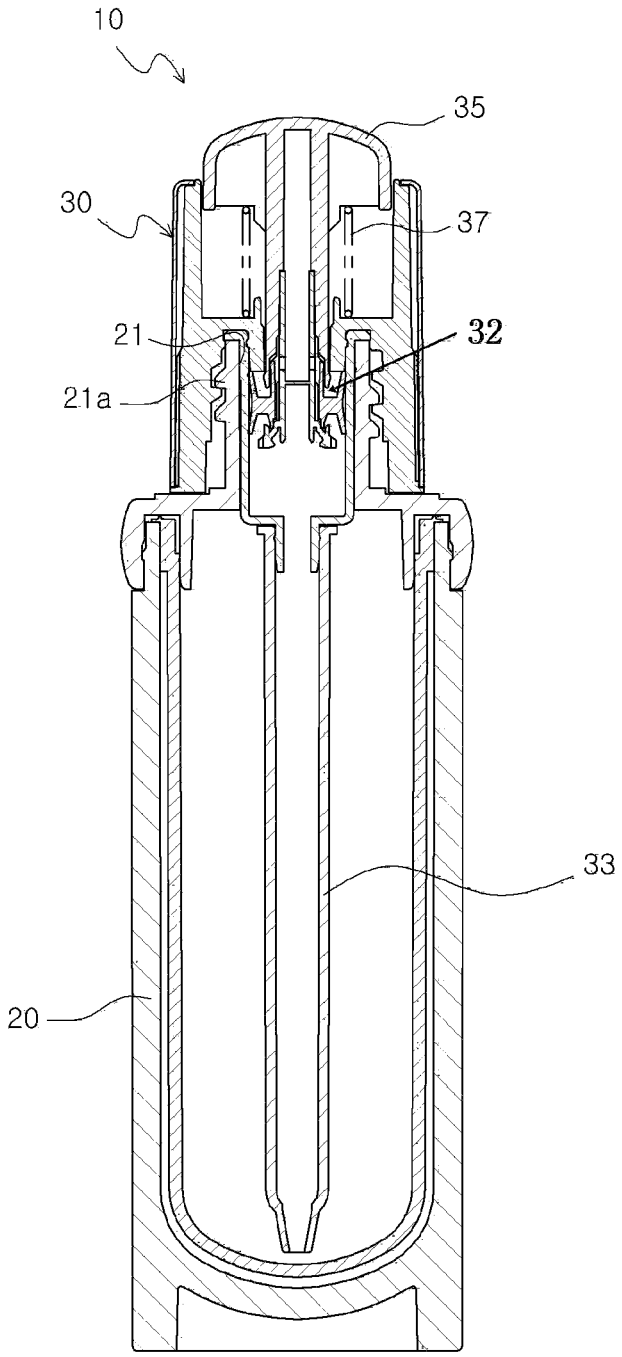
FIG. 1 is a perspective view illustrating an existing spouting-type cosmetic container.
Figure 2:
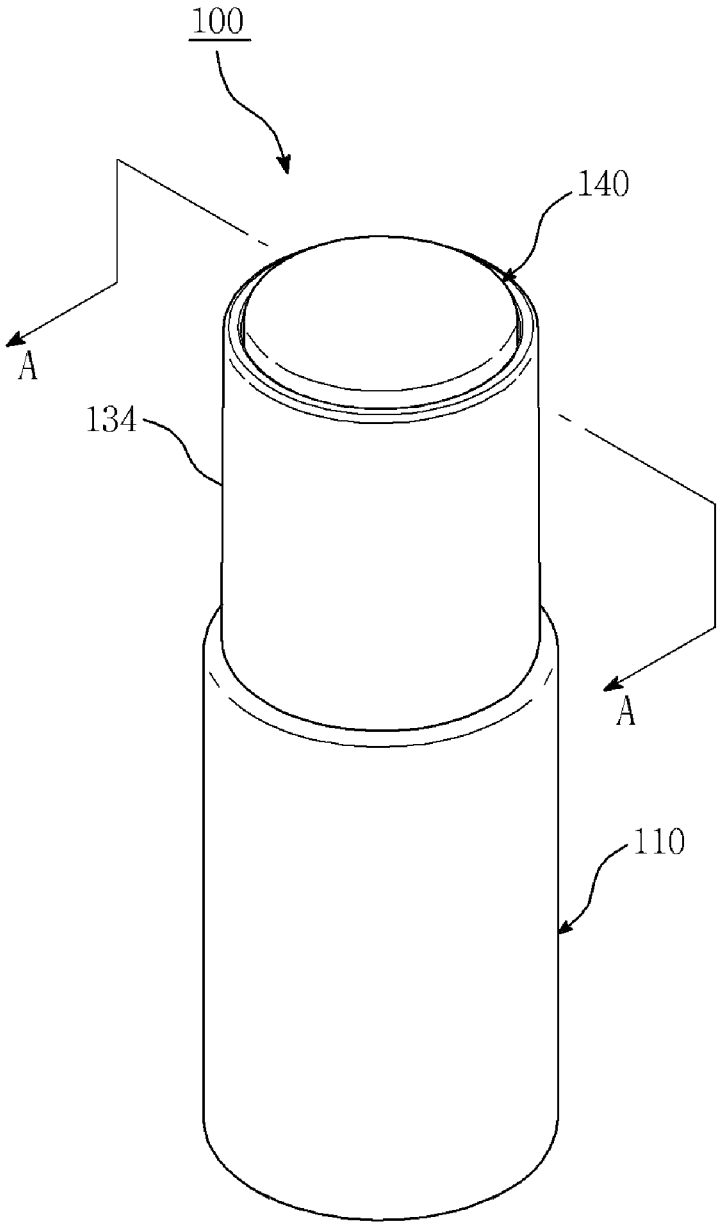
FIG. 2 is a perspective view illustrating a spouting-type cosmetic container according to an embodiment of the present invention.
Figure 3:
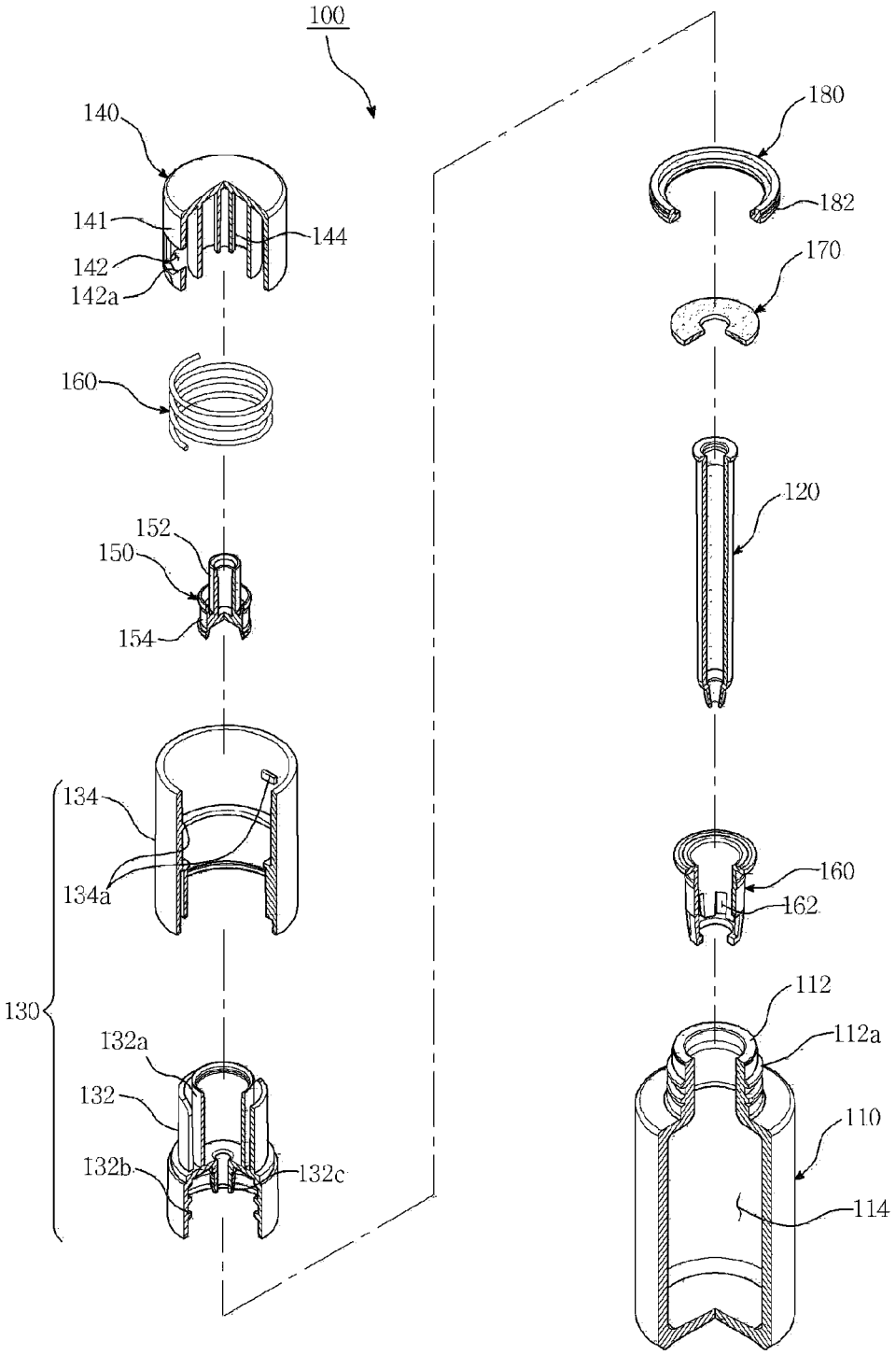
FIG. 3 is an exploded perspective view illustrating the spouting-type cosmetic container according to the embodiment of the present invention.
Figure 4:
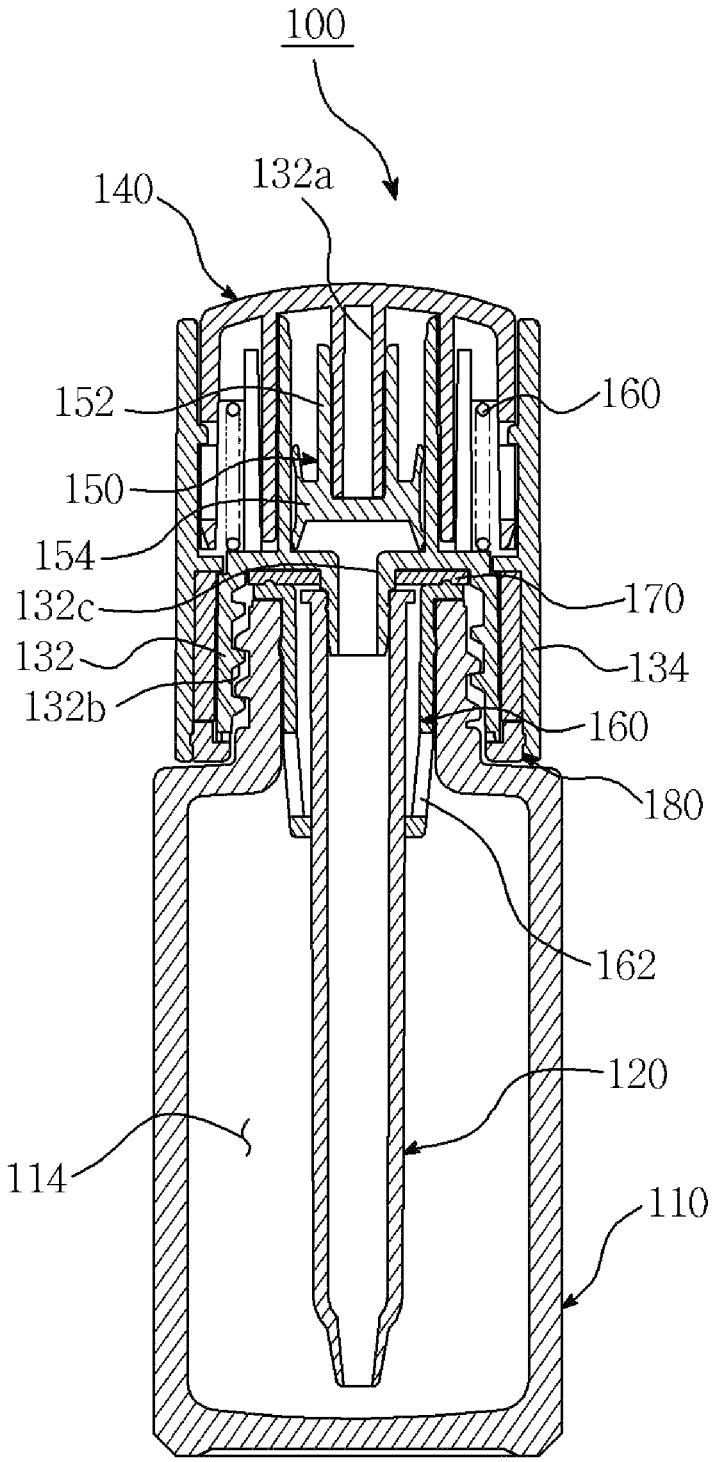
FIG. 4 is a sectional view taken along line A-A' of FIG. 2.

A spouting-type cosmetic container 100 according to an embodiment of the present invention, as illustrated in FIGS. 2 to 4, includes a main container 110, a pipette tube 120 for spouting cosmetics accommodated in the main container 110, a cap unit 130 having an inner cap 132 and an outer cap 134, an up/down button 140 moving up and down on the outer cap 134, a piston 150, and an elastic member 160 elastically reacting when the cap unit 130 is separated from the main container 110 to spout the cosmetic.

The main container 110, as illustrated in FIGS. 3 and 4, is provided with an accommodating space of a preset scale in which the cosmetic is accommodated. The main container 110 is preferably provided with male threads 112*a* formed on an opening 112 of the main container 110 such that the main container 110 may be thread-coupled with the inner cap 132.

The pipette tube 120 spouts the cosmetic accommodated in the main container 110. The pipette tube 120 extends a preset length and goes in and out the main container 110 through the opening 112. The pipette tube 120 may be fixed stably by a close fixing unit 132*c* of the inner cap 132.

The cap unit 130 is detachably installed to the opening of the main container 110. The cap unit 130 includes the inner cap 132 thread-coupled to the main container 110 and the outer cap 134 encasing the inner cap 132.

The inner cap 132 extends a preset length and is provided around the opening 112 of the main container 110. Female threads 132*b* are formed on the lower inner circumference of the inner cap 132 for the thread-coupling with the opening 112 of the main container 110. A penetrated close fixing unit 132*c* is provided in the center of the inner cap 132 and the pipette tube 120 is closely fixed thereto. An extension segment 132*a* extends upwardly from a position near the close fixing unit 132*c* of the inner cap 132.

A rubber leak-proof member 170 may be provided between the inner cap 132 and the opening 112 of the main container 110 to prevent the cosmetic from leaking.

Moreover, a penetrated wiper 160 may be further provided between the inner cap 132 and the opening 112. The wiper 160 wipes down the cosmetic attached to the outer circumference of the pipette tube 120 to be accommodated in the accommodating space 114 of the main container 110. The wiper 160 includes an externally bent top supported by a top side of the opening 112 of the main container 110 and an internally bent bottom closely attached to the outer circumference of the pipette tube 120. The wiper 160 is formed with a collecting hole 162 formed in the lower side of the wiper 160 and serving as a passage for the cosmetic attached to the outer surface of the pipette tube 120 and wiped down.

The outer cap 134 encases the inner cap 132 and is provided on the upper side of the main container 110. The outer cap 134 has a cam 134*a* inwardly protruding from the upper inner circumference of the outer cap 134. The cam 134*a* makes a pair facing the inner circumference of the outer cap 134.

The up/down button 140 is installed in the upper side of the outer cap 134 to be lifted up and down by a preset stroke. The up/down button 140 has a pair of horizontally penetrated cam holes 142 formed on the side wall of the up/down button and facing the cams 134*a*. The cam holes 142 are provided with '/'-shaped slope guides 142*a* with a preset angle in the lower side thereof.

With the above-mentioned configuration, the cams 134*a* are supported by the slope guides 142*a* and rotate clockwise when the up/down button 140 is pressed and the up/down button 140 moves down. On the contrary, when the cap unit 130 is rotated counterclockwise and separated from the main container 110, the cap unit 130 is transferred with the elastic reaction of the elastic member 160 and rotates counterclockwise and the cams 134*a* are supported by the slope guides 142*a* such that the up/down button 140 moves up gradually.

The piston 150 has a reversed T-shape. The piston 150 has a fixing protrusion 152 extending from the top center of the piston 150 and fixed to a fixing element 144 of the up/down button 140. The piston 150 is provided with a leak-proof segment 170 preventing leakage of the cosmetic on the lower side of the piston 150. The leak-proof segment 170 protrudes outwardly from both sides of the fixing protrusions 152 to be in contact with the extension segment 132*a*. The piston 150 moves upward with the up/down button 140 due to the elastic reaction of the elastic member 160 when the cap unit 130 is rotated and separated from the main container 110 and pipets the cosmetic from the main container 110.

The elastic member 160 is provided between the inner cap 132 and the up/down button 140 and reacts elastically when the cap unit 130 is rotated and separated from the main container 110. That is, the elastic member 160 moves the up/down button 140 and the piston up using the elastic reaction during the rotational separation of the inner cap 132 from the main container 110 to spout the cosmetic accommodated in the main container 110.

The spouting-type cosmetic container according to the embodiment of the present invention may further include a stopper 180 between the opening 112 and the outer cap 134 of the main container 110. The stopper 180 is provided with rotation-preventing protrusion 182 protruding outwardly to control the rotation of the outer cap 134.

Hereinafter, operations of the spouting-type cosmetic container 100 according to the embodiment of the present invention will be described.

First, in order to suction the cosmetic accommodated in the main container 110 into the pipette tube 120, the main container 110 is thread-coupled with the cap unit 130 such that the piston 150 and the up/down button 140 move down.

That is, the main container 110 is grasped with a hand while the outer cap 134 is gripped with the other hand to rotate clockwise. Then, the cap unit 130 rotates and the piston 150 and the up/down button 140 move down.

During this process, if the inner cap 132 is coupled with the opening 112 of the main container 110 and does not rotate further, the up/down button 140 slides against the outer cap 134 and rotates clockwise by a preset rotational angle.

At this time, the slope guides 142*a* formed in the cam holes 142 of the up/down button are guided by the cams 134*a* on the inner circumference of the outer cap 134 and moved from the upper right side to the lower left side.

By doing so, the inner volume of the piston 150 is reduced as the piston 150 fixed to the lower side of the up/down button 140 descends and air is discharged out into the main container 110 via the pipette tube 120.

After that, the thread-coupled main container 110 and cap unit 130 are separated from each other to allow the up/down button 140 to move up and down.

During this process, since the inner cap 132 is tightly coupled with the opening 112 of the main container 110, the outer cap 134 rotates firstly while the inner cap 132 does not rotate.

As such, since the up/down button 140 slides against the outer cap 134 and rotates and the elastic member 160 elastically supports the up/down button 140 upward when the outer cap 134 rotates, the slope guides 142*a* formed in the cam holes 142 of the up/down button 140 are guided obliquely from the lower left side to the upper right side by the cam protrusions 134*a* of the outer cap 134 to move the up/down button 140 and the piston 150 upwardly.

By doing so, the upward movements of the up/down button 140 and the piston 150 make the cosmetic accommodated in the accommodating space 114 of the main container 110 be suctioned into the pipette tube 120.

After that, when the outer cap 134 is rotated counterclockwise, the inner cap 132 is fully separated from the opening 112 of the main container 110 and a user may apply the cosmetic to a desired spot for make-up by pressing the up/down button 140 to discharge the cosmetic out.

Although the exemplary embodiment of the present invention has been described in detail, the present invention is not limited by the embodiment but may be variously modified without departing from the scope of the present invention.

DESCRIPTION OF REFERENCE NUMERALS

100: Spouting-type cosmetic container
110: Main container
112: Opening
112*a*: Male threads
114: Accommodating space
120: Pipette tube
130: Cap unit
132: Inner cap
132*a*: Extension segment
132*b*: Female threads
132*c*: Close fixing unit
134: Outer cap
134*a*: Cams
140: Up/down button
142: Cam holes
142*a*: Slope guides
144: Fixing element
150: Piston
152: Fixing protrusions
154: Leak-proof segment
160: Elastic member
162: collecting holes
170: Leak-proof member
180: Stopper
182: Rotation-preventing protrusion

The invention claimed is:

1. A spouting-type cosmetic container comprising:

a main container provided with an opening formed at the top;

a pipette tube for spouting cosmetic material accommodated in the main container out;

a cap unit detachably installed to the opening of the main container and including an inner cap thread-coupled with the main container and an outer cap encasing the inner cap and provided with cams formed on the inner circumference thereof;

an up/down button installed to the upper side of the outer cap to move up and down for a preset stroke and having cam holes formed on the side wall to face the cams;

a piston fixed to the lower side of the up/down button to move up and down with the up/down button; and an elastic member elastically reacting when the cap unit is separated from the main container to move the up/down button and the piston upward and to spout the cosmetic accommodated in the main container out, wherein the piston has a T-shape and comprises:

a fixing protrusion extending from the upper center thereof upward and fixed to a fixing element of the up/down button; and leak-proof segments protruding from both sides of the fixing protrusion outwardly to be in contact with an extension segment of the inner cap to prevent the cosmetic from leaking.

2. The spouting-type cosmetic container of claim 1, wherein the cams make a pair of protrusions extending inwardly from an inner circumference of the outer cap at positions facing each other, the cam holes includes '/'-shaped slope guides formed in the lower side with a preset angle and penetrate the side wall of the up/down button at a position corresponding to the cams, the cams are supported and rotated clockwise by the slope guides when the up/down button is pressed to move the up/down button down and is transferred with elastic reaction of the elastic member when the cap unit is rotated and separated from the main container and rotates counterclockwise to support the slope guide such that the up/down button is gradually moved upwardly.

3. The spouting-type cosmetic container of claim 1, further comprising a wiper provided between the inner cap and the opening of the main container to wipe down the cosmetic attached to the outer circumference of the pipette tube.

4. The spouting-type cosmetic container of claim 1, further comprising a leak-proof element preventing the cosmetic from leaking between the inner cap and the wiper.

5. The spouting-type cosmetic container of claim 1, further comprising a stopper provided between the opening of the main container and the outer cap and having a rotation-preventing protrusion to control the rotation of the outer cap within a preset rotational angle.

* * * * *